United States Patent [19]

Roser et al.

[11] Patent Number: 5,050,765

[45] Date of Patent: Sep. 24, 1991

[54] TRANSPORT AND/OR STORAGE CONTAINER FOR FLOWABLE MATERIALS

[75] Inventors: Georges Roser, Wingen; Pierre Pfeiffer; Andre Hamm, both of Drulingen, all of France

[73] Assignee: Sotralentz S.A., Drulingen, France

[21] Appl. No.: 422,390

[22] Filed: Oct. 16, 1989

[30] Foreign Application Priority Data

| | | | |
|---|---|---|---|
| Oct. 15, 1988 | [DE] | Fed. Rep. of Germany | 3835257 |
| Nov. 12, 1988 | [DE] | Fed. Rep. of Germany | 3838495 |
| Nov. 26, 1988 | [DE] | Fed. Rep. of Germany | 3839999 |
| Feb. 25, 1989 | [DE] | Fed. Rep. of Germany | 3905976 |

[51] Int. Cl.[5] ..... B65D 88/26

[52] U.S. Cl. ..... 220/401; 220/403; 220/492; 220/494; 206/599; 222/183

[58] Field of Search ..... 220/401, 403, 404, 19, 220/1.5, 72.1, 408, 410, 491, 492, 494, 610, 635; 222/105, 183; 206/599

[56] References Cited

U.S. PATENT DOCUMENTS

| | | | |
|---|---|---|---|
| 379,631 | 3/1888 | Brewster | 220/491 |
| 2,137,739 | 11/1938 | Gatch | 220/494 |
| 2,230,382 | 2/1941 | Lutzke | 220/19 |
| 2,471,095 | 5/1949 | Coit | 206/599 |
| 2,735,568 | 2/1956 | Bitney | 220/491 |
| 2,806,624 | 9/1957 | Beckner | 220/19 |
| 3,111,242 | 11/1963 | Reed | 222/183 |
| 3,433,400 | 3/1969 | Hawkins | 222/183 |
| 3,638,834 | 2/1972 | Goodrich et al. | 222/105 |
| 3,887,073 | 6/1975 | Wilson | 220/19 |
| 3,964,636 | 6/1976 | Rehrig | 220/401 |
| 4,306,668 | 12/1981 | Love | 222/105 |
| 4,306,669 | 12/1981 | Grether | 222/105 |
| 4,676,373 | 6/1987 | Schneider | 220/401 |
| 4,795,057 | 1/1989 | Jungels | 220/401 |
| 4,817,824 | 4/1989 | Lafleur | 222/105 |
| 4,909,387 | 3/1990 | Schutz | 220/401 |

FOREIGN PATENT DOCUMENTS

| | | | |
|---|---|---|---|
| 1038808 | 9/1978 | Canada | 220/403 |
| 132853 | 11/1978 | Fed. Rep. of Germany | 220/404 |
| 2523078 | 9/1983 | France | 206/599 |

*Primary Examiner*—Stephen Marcus
*Assistant Examiner*—S. Castellano
*Attorney, Agent, or Firm*—Herbert Dubno; Andrew Wilford

[57] ABSTRACT

A large-volume storage and transport container has a flexible wall inner vessel within an outer vessel of gridwork. The bottom of this outer vessel is likewise formed as a gridwork and stabilized by welding with additional bars if necessary. Pallet feet or other palletizing elements can be formed on the additional bars, welded to the bottom or otherwise attached thereto.

8 Claims, 7 Drawing Sheets

TRANSPORT AND/OR STORAGE CONTAINER FOR FLOWABLE MATERIALS

CROSS REFERENCE TO RELATED APPLICATIONS

This application is related to the commonly assigned copending applications Ser. No. 07/388,828 filed Aug. 1, 1989 (now U.S. Pat. No. 4,962,863) and Ser. No. 07/324,371 filed Mar. 15, 1989.

FIELD OF THE INVENTION

Our present invention relates to a transport and/or storage container for flowable materials, i.e. liquids and finely divided solids or other bulk materials which are capable of being discharged from the container by a flow therefrom. More particularly, the invention relates to a container of the type described which may be provided with means enabling it to be handled by a forklift truck and is thus a so-called palletized container, and especially to a transport or storage container having an outer support structure and a cage-like configuration or gridwork in which an inner container, e.g. a blow-molded synthetic resin or plastic bag, is supported.

BACKGROUND OF THE INVENTION

It is known to provide large-volume containers in which an outer support structure of cage-like construction composed, for example, of a gridwork of round-steel bars or wire, serves to support a flexible-wall inner container of a plastic material. The inner container, when filled with a flowable material, is braced against at least one lateral wall formed by the support structure and rests upon a bottom of the outer support. The gridwork, as noted, can be composed of round-steel bar and/or wire, both of which may be collectively referred to as bars hereinafter, and formed or strengthened by hot or cold-shaping processes including drawing or rolling.

In the gridwork structure, the bars cross one another and are welded together at their crossing points.

In general, in earlier constructions, the upper part of the lateral support was generally fitted with a frame to which the bars of the gridwork could be welded and which can be constituted of steel profile, i.e. steel structural shapes of a variety of cross sections.

In the prior art transport and/or storage container of the aforedescribed type and over which the present invention is an improvement, the bottom of the container was a separate structure. For example, it could be formed by the upper surface of a pallet of wood or sheet metal which could be connected to the outer cage structure in some special way.

The term "pallet" is used herein to refer to a structure which enables the transport and/or storage container to be handled, i.e. moved about, by the fork of a forklift truck or the like. Using such a forklift vehicle, of course, the palletized container can be lifted onto a truck, lifted off a truck, stacked or simply moved about on a support surface in a particularly convenient manner.

In all of these earlier systems, the bottom of the container was formed by a foreign body which, although connected with the outer cage structure, nevertheless had a reduced form stability.

For example, when the bottom was a wood pallet structure, deterioration thereof in normal handling of the transport and storage container could not be avoided. By and large, therefore, the bottoms of earlier containers had a much shorter useful life than the gridworks of the outer structures to which those bottoms were connected and which were composed of steel bars or the like.

OBJECTS OF THE INVENTION

It is, therefore, the principal object of the present invention to provide a transport and/or storage container of the above-described type which can be provided with pallet elements but wherein the drawbacks of earlier systems are avoided.

Another object of the invention is to provide an improved transport and storage container utilizing a gridwork outer support structure but with an improved bottom structure which will deteriorate less readily than earlier container bottoms and thus will have a longer useful life, greater shape-retentivity and, in general, improved handling by comparison with earlier systems.

Still another object of this invention is to provide an improved transport and storage container having greater strength and stability than earlier containers and designed so that the container will be less subject to damage or to rupture of the inner vessel when the container is filled and in a filled state is manipulated and subjected to the normal exigencies of such manipulation, e.g. dropping, for example, from a crane.

SUMMARY OF THE INVENTION

These objects and others which will become apparent hereinafter are attained, in accordance with the invention in that vertical gridwork bars of the outer structure are bent to lie in the bottom plane and are welded together, if desired, together with additional grid bars lying alongside the bars bent from extensions of the vertical bars. As a consequence, all or some of the vertical grid bars can be bent and can unitarily form a gridwork structure constituting the bottom and welded to crossing bent extensions of the vertical bars or to additional horizontal grid bars. Because of the grid structure of the bottom, reinforced by the additional bars or elements, deterioration of the bottom structure prematurely is precluded.

The bottom-forming grid bars can be disposed one upon the other or interwoven or laid into one another in a weave-type construction. The latter can be a linen-type interweaving of the gridwork bars of the bottom member.

In a preferred embodiment of the invention, the outer structure or member can have a rectangular or square plan configuration with two pairs of opposite sides so that the bent extensions of one pair of opposite sides can overlap and be welded together at their ends. Similarly, the bent extensions of the other bar of opposite sides can lie outwardly or inwardly of the array of bars formed by the extensions of the first side and can be welded thereto at crossing points. The welded ends preferably lie side by side.

In this embodiment, additional grid bars can be provided along the outer side of the bottom or along the inner side thereof and, as is self-understood, can be welded to the bars of the gridwork, preferably with spot welds.

According to a preferred embodiment of the invention, the additional grid bars are deformed to provide pallet feet for enabling the container to be handled by means of a forklift truck or the like.

The transport and/or storage container is not, of course, limited to a rectangular or square-plan outline. It is possible to provide the outer structure as a cylindrical cage and to so bend the vertical bars so that their extensions lie radially and can be reinforced by circular horizontal bars or rings welded thereto. In all cases it is preferred to provide, with the gridwork of the bottom member, a relatively flat structure upon which the inner vessel can be braced or which can seat firmly on the ground without rocking.

If the transport and/or storage container is provided with pallet feet or the like, then the container itself will be said to be a palletized container.

While preferably the pallet elements are shaped from the additional bars welded onto the gridwork of the bottom member, it is possible to fit pallet elements in the form of wood or other bottom pallet structures to the gridwork of the bottom member. These additional elements can be attached to the bottom gridwork formed by the bent bars by any conventional fastening means. Individual pallet elements from round steel bars or sheet metal can, of course, be welded onto the bottom gridwork if desired.

In its broadest terms, therefore, the invention can be considered to be a transport or storage container which comprises:

an outer support member comprised of at least one lateral support wall in the form of a gridwork of horizontal and vertical bars;

a bottom member formed as a gridwork of bars connected to the bars of the gridwork of the outer support member; and an inner vessel composed of a plastic material enclosed by the outer support member and supported on the bottom member, at least one of the members having bars of the respective gridwork bent to extend from an outer portion of the container into a plane of the bottom member and welded to other bars of the bottom member.

According to another aspect of the invention, a method is provided for fabricating the outer structure of a transport and storage container. This method comprises forming from grid bars a planar-receiving head section with outer structure parts and bottom parts having bending zones and seam or weld zones. The outer structure parts and the bottom parts are respectively brought together to form the outer structure and the bottom structure or members and the grid bars are then welded together.

The bottom parts can be formed by bending from extensions of the vertical grid bars and the outer structure with the ends being welded together and the bars being welded at their crossing points.

It is also possible to form each of the structures or members from flat sections of a gridwork and to provide the bottom member with the bends so that the bottom member is then welded to the corresponding bars of the outer structure.

In this latter case, of course, the flat or planar gridwork the bottom member can be bent and welded along the edge zones of the container to the outer structure. The two sections of the flat gridwork from which the outer structure and bottom member are formed should then have the same raster spacing of the grid bars so that in the seam zone complementary grid bars are juxtaposed and welded together.

The method in its broadest aspect, therefore, is a method of making a transport and storage container for flowable materials, comprising:

an outer support member comprised of at least one lateral support wall in the form of a gridwork of horizontal and vertical bars;

a bottom member formed as a gridwork of bars connected to the bars of the gridwork of the outer support member; and an inner vessel composed of a plastic material enclosed by the outer support member and supported on the bottom member, the method comprising the steps of:

(a) forming the bars of one of the members with bends extending from an outer portion of the container into a plane of the bottom member; and (b) welding the bars together at least in the plane.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
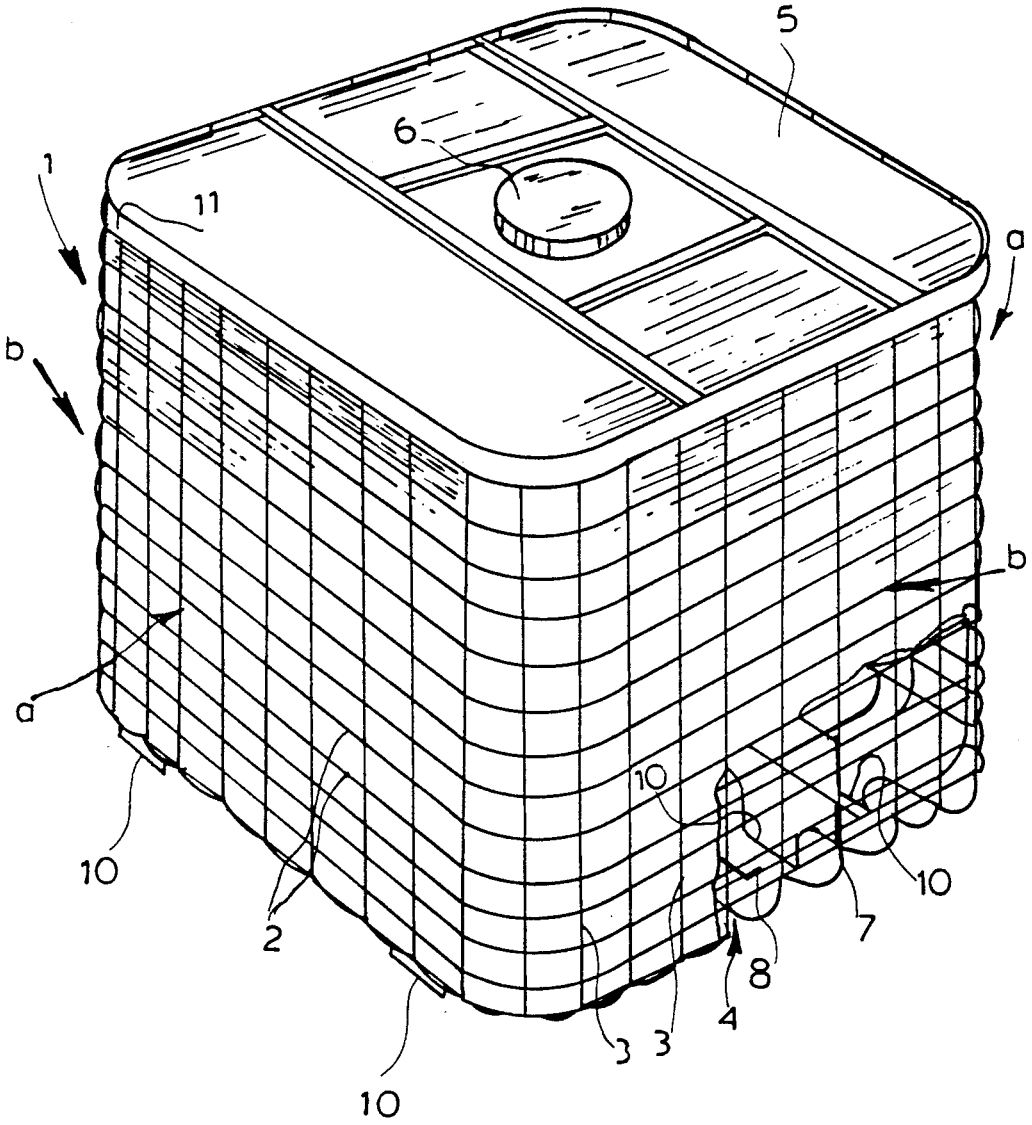
FIG. 1 is a perspective view in highly diagrammatic form and partly broken away, illustrating a transport and storage container in accordance with the present invention in a form as a palletized container.

The transport and/or storage container illustrated in FIG. 1 is intended for handling liquids or finely divided bulk materials which are flowable and comprises, in its basic construction, an outer support structure 1 of a grid of horizontal grid bars 2 and vertical grid bars 3, a bottom generally represented at 4 and an inner vessel 5 which can be blow-molded of synthetic resin material.

The inner vessel 5 of plastic, because of its flexible wall structure, acts as a bladder which, when filled with a liquid or flowable solids, is braced against the inner surface of the outer support structure 1 and rests upon the bottom 4.

Figure 2:
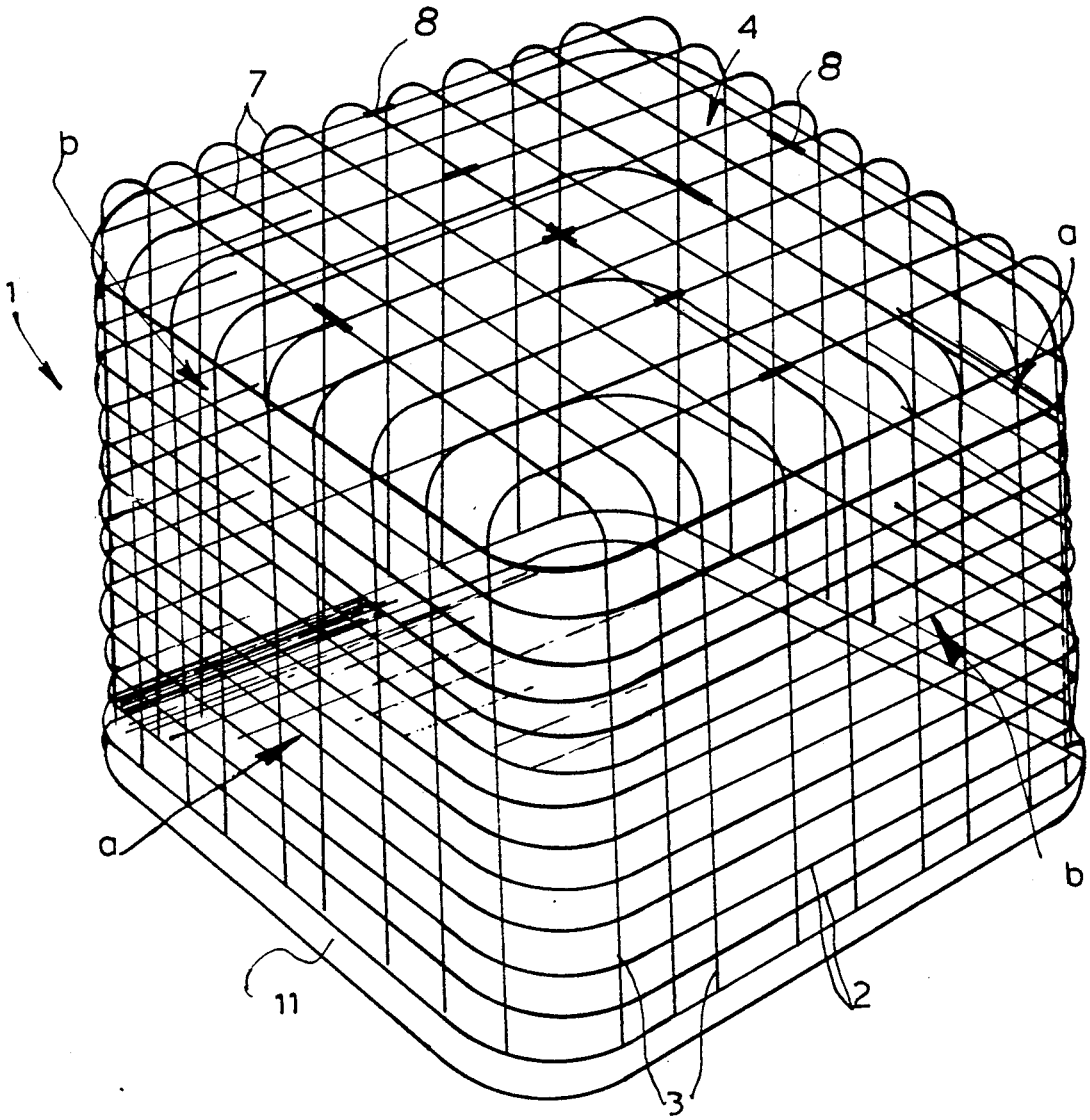
FIG. 2 is a perspective view of the outer support structure or cage of that container turned upside down, with the pallet elements omitted and also with the vessel having been removed.
Figure 3:
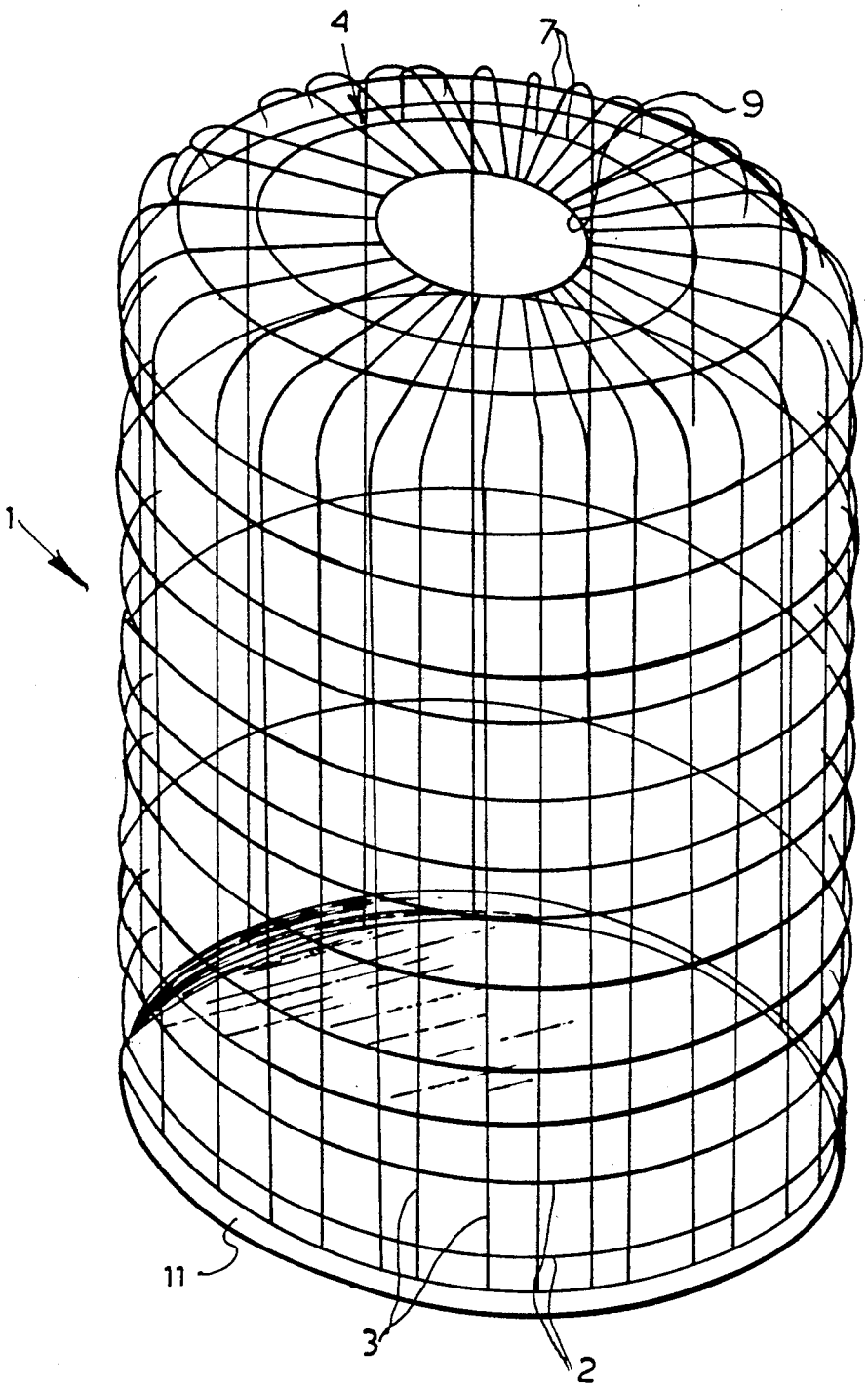
FIG. 3 is a view similar to FIG. 2 of another embodiment of the outer support structure.

FIG. 1 shows sketchily while FIGS. 2 and 3 illustrate in greater detail that the vertical grid bars 3 of the outer support structure 1 are bent from the vertical into a plane of the bottom and together with other extensions of the vertical bars similarly bent, horizontal grid bars of the outer support structure and/or additional grid bars 7 which lie along the vertical bars or those which have been bent to form the bottom plane, are welded together.

Figure 4:
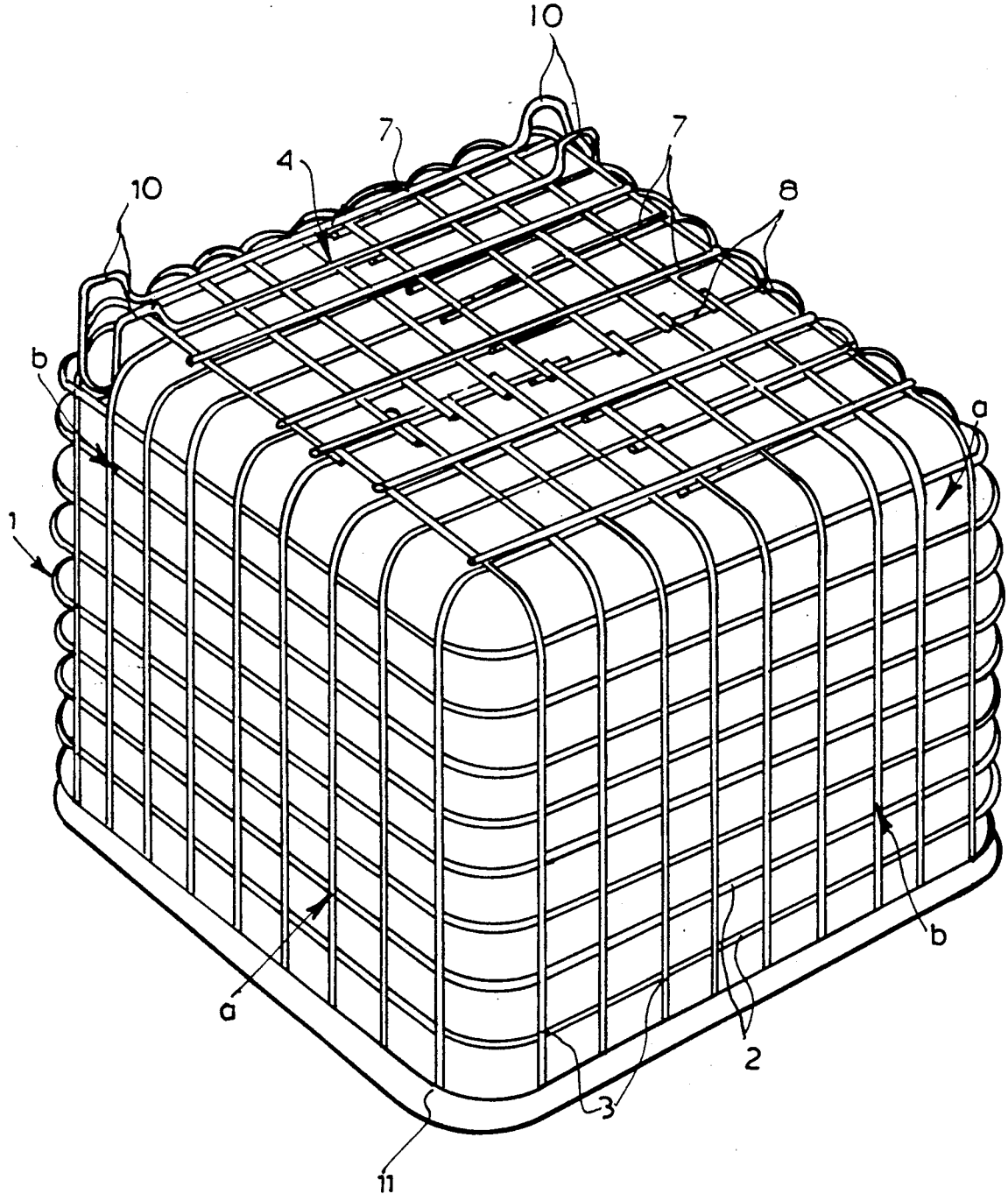
FIG. 4 is a view similar to FIG. 2 of another embodiment.

More specifically, in the embodiment of FIGS 1 and 2, the outer support structure 1 has a rectangular plan configuration (see FIGS. 1, 2 and 4).

The vertical grid bars 3 from one pair of opposite side walls (a) are bent toward one another and have their ends lying side by side and welded together at 8. The other pair of vertical walls have their grid bars 3 extended and bent to underlie the grid bars from the first pair of walls (FIG. 2) and, in addition to being welded together at overlapping regions at their ends, the bars are spot-welded at their crossing points.

As can be seen from FIG. 4, additional bars 7 can underlie the outermost array of bars and can be welded at the crossing points thereof as well.

Figure 8:
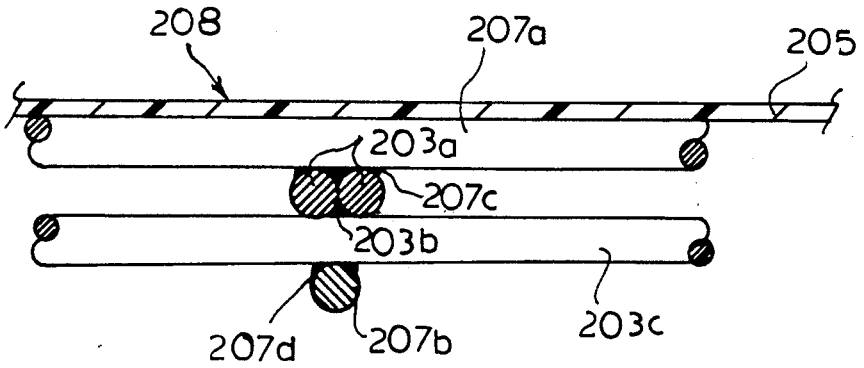
FIG. 8 is a cross sectional view through a bottom gridwork in the region in which it supports the floor of the inner vessel.

From FIG. 8 it will be apparent that the additional bars 207*a* and 207*b* can extend in either direction and can directly underlie the floor 205 of the inner vessel and thus be provided on the interior of the bottom, or can be provided on the exterior thereof.

The bent bars 3 and horizontal bars which form the gridwork thereof can be bent to form the bottom as a unit, if desired, and can be stiffened by the additional bars 7. In any event the gridwork member forming the bottom is capable of withstanding all stresses and has sufficient bending stiffness to protect the inner vessel. In the latter case, the outer support structure and the bottom can be formed unitarily from a single gridwork section bent to cause the bottom portion to lie at a right angle to a lateral wall portion.

FIG. 3 shows an embodiment of the invention with a round outline in which the vertical grid bars are bent so that, along the bottom, they extend generally radially.

The additional grid bars 7 are here circular bars or rings which are welded to the radial extensions of the vertical grid bars.

In the center, a circular opening 9 can be provided.

Figure 5:
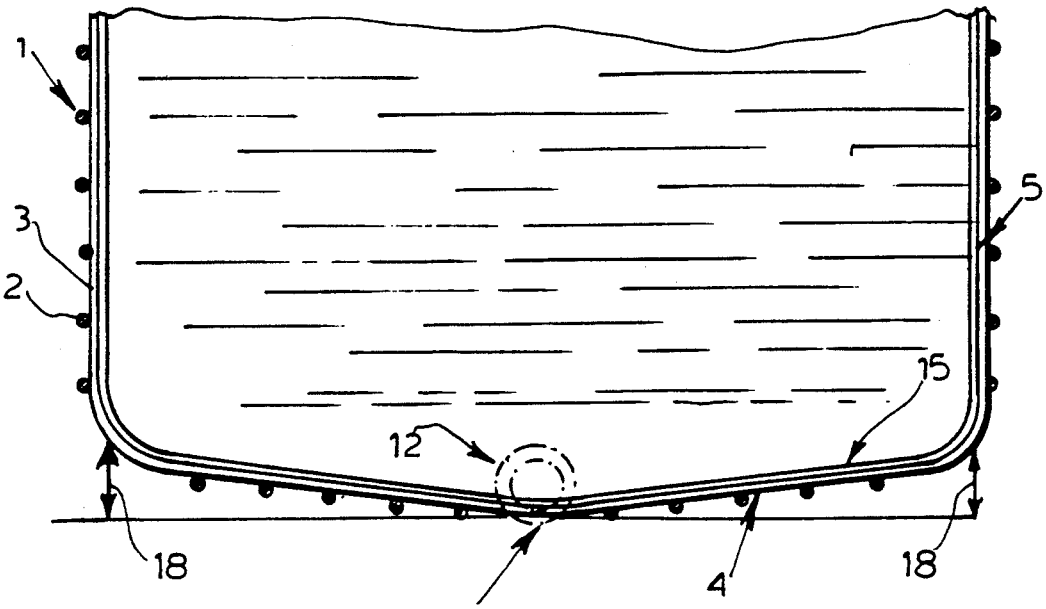
FIG. 5 is a cross sectional view through the container of FIG. 1, drawn to a somewhat larger scale and illustrating a special bottom construction for the container.
Figure 6:
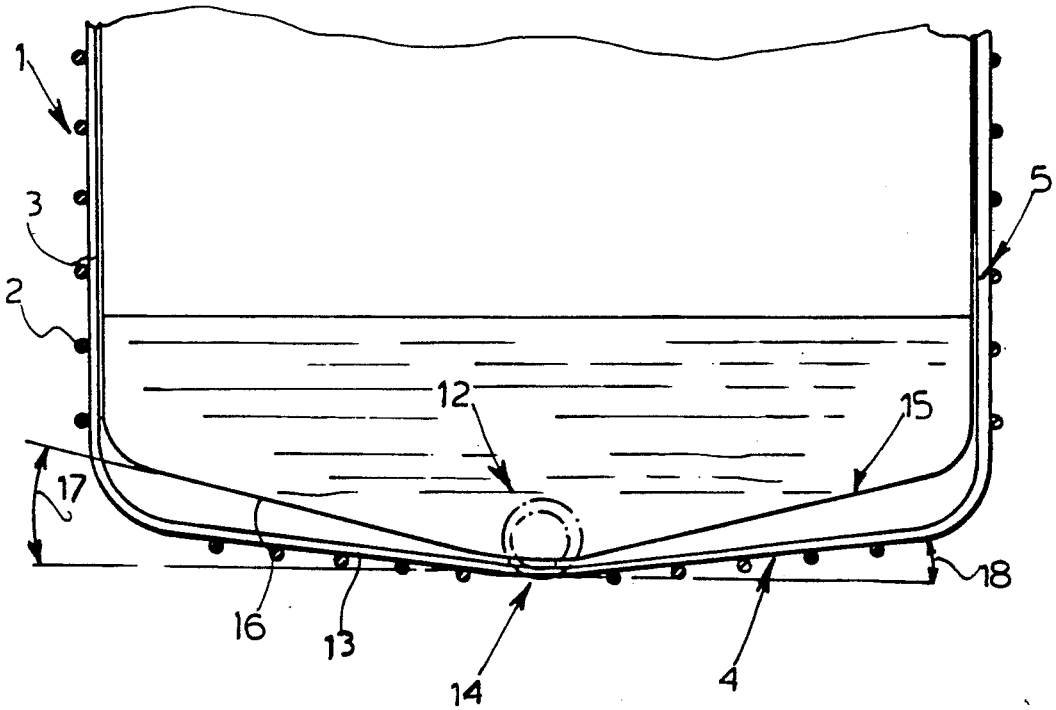
FIG. 6 is a view similar to FIG. 5 showing the relative positions of the floor of the inner vessel and the bottom of the outer structure when the inner vessel is partly empty.

It will also be apparent from FIG. 3 that the bend of each vertical grid bar into the bottom plane is effected With a radius corresponding to the rounded form of the vessel received therein (see FIGS. 5 and 6 in this connection as well).

The container of FIG. 1 is formed as a palletized container and, for this purpose, pallet-foot elements 10 can be formed on the additional bars 7 along two opposite sides of the container. These foot elements have the configuration of stirrups into which the fork of a forklift truck can be inserted to manipulate the container when filled or empty.

In this case, the bottom 4 forms simultaneously the upper surface of the pallet.

Separate pallet elements like a wood pallet, a sheet metal pallet or even a plastic pallet can be applied to the foot members 10 or can be connected independently to the bottom.

In another alternative, stirrup-shaped foot elements 10 can be welded directly to the bottom bars independently of the additional bars 7.

At the upper edge of the outer support structure 1, a stabilizing frame 11 can be provided of steel structural shapes which are welded to the vertical grid bars 3.

FIG. 4 shows the relationship of the ends of the bars bent into the bottom plane and their welding together at 8 in greater detail. The feet 10 here can receive additional shoes or skids of wood, plastic or metal.

From FIGS. 5 and 6 it will be apparent that the bottom 4 is inclined downwardly and forwardly toward the lateral side from which an emptying fitting 12, e.g. a tap or cock, can extend from the inner vessel.

The inclination defines inclined surfaces 13 which have, as their lowest point 14, a region in the vicinity of the emptying fitting 12. The inner vessel 5 has a correspondingly shaped floor 15.

The bottom 4 may, in a plan view, have a substantially Y-shaped bent region with the steel bars 3 being correspondingly bent and such that the shank of the Y extends downwardly and outwardly in the vicinity of the emptying fitting 12 of the inner vessel 5. The bottom 4, to facilitate runoff, can be inversely peak-shaped to define a trough inclined downwardly and outwardly toward the outlet fitting 12.

As a comparison of FIGS. 4 and 5 will show, the floor 15 of the inner vessel 5 has a bottom surface 16 which is inclined at an angle 17 to the horizontal in a partially emptied or completely emptied state of the inner vessel 5 which is greater than the corresponding angle of inclination 18 to the horizontal of the bottom 4. Either the floor 15 in the filled state of the inner vessel 5 by elastic deformation thereof rests flatly against the bottom 4, so that the floor is raised from the bottom 4 as shown in FIG. 6 by elastic action only upon partial emptying.

As will be apparent from the foregoing, the bottom can be provided in a variety of ways. For example, it may originally be part of a lateral wall when the latter is cut from a previously-formed planar gridwork and simply bent at a right angle to this lateral wall with other bends connecting to other lateral walls and being welded thereto at the so-called seam zones.

Figure 7:
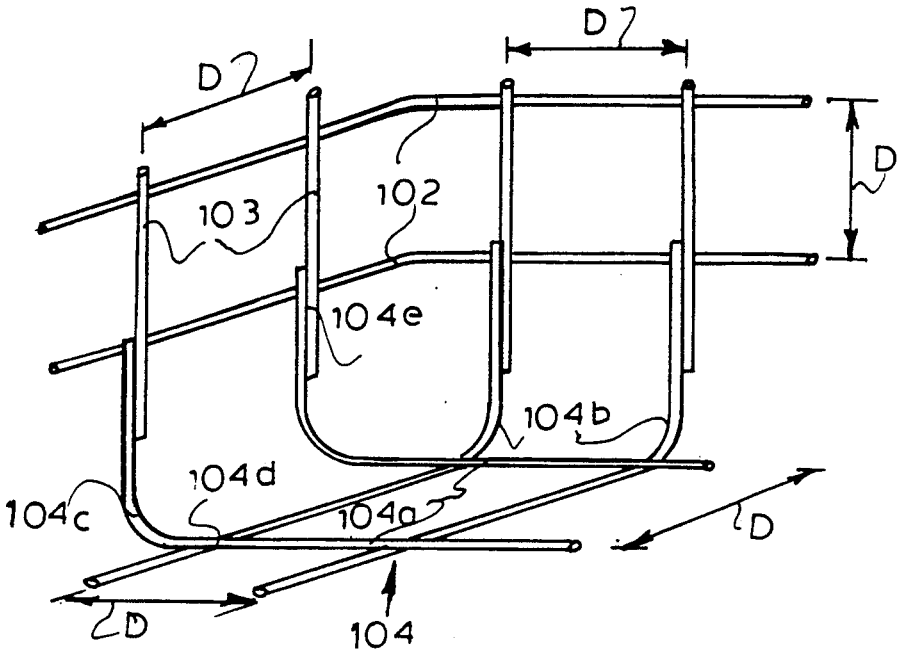
FIG. 7 is a fragmentary perspective view illustrating another aspect of the invention.

The lateral walls and the bottom may be separately shaped from sections of gridwork having the same raster spacing D (FIG. 7) and bends can then be provided on the bottom member. In FIG. 7, therefore, the horizontal bars and vertical bars of the support structure have been represented at 102 and 103, respectively, whereas the bottom 104 is shown to consist of welded together bars 104*a* having spot welds at 104*d* at their crossing points.

Bends 104*b* and 104*c* are provided in the bars 104*a* and corresponding bent bars of the bottom 104 are then welded at 104*e* to the vertical bars 103 and, if desired, to horizontal bars 102.

The method whereby the vertical bars have been bent to form the bottom has been illustrated in connection with FIG. 4.

FIG. 8 merely serves to show that the bars 203*a* and 203*c* can e welded together at 203*b* to form the bottom. The additional bars 207*a* and 207*b*, previously mentioned are welded at 207*c* and 207*d* to the bars forming the bottom.

Figure 9:
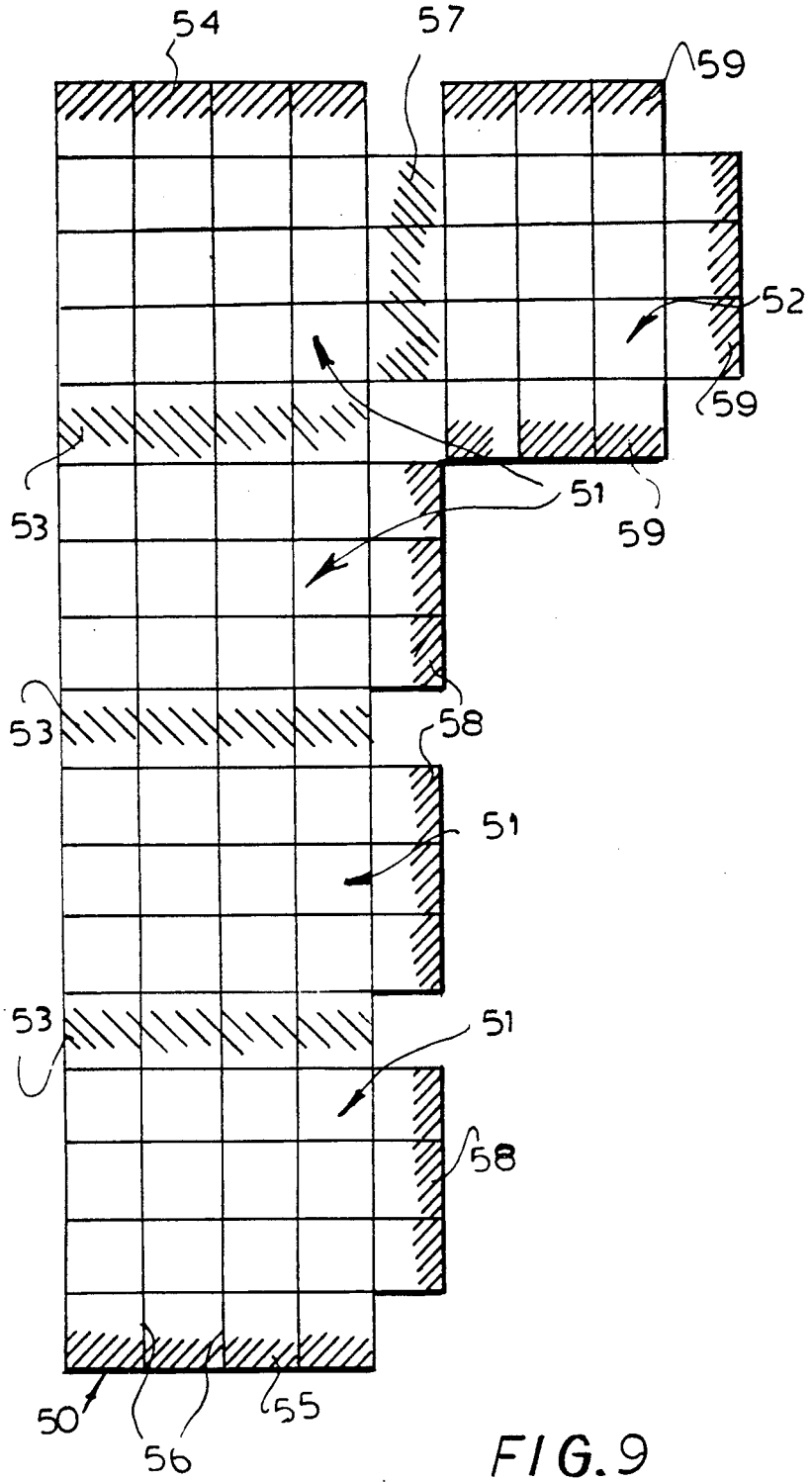
FIG. 9 is a diagrammatic plan view of the layout of a gridwork blank which can be used to form the container outer enclosure of the invention by the principles described above and below.

In FIG. 9, we have shown a gridwork blank 50 which can be cut from a concrete-reinforcing mat composed of circular steel reinforcing rods or some other factory-produced gridwork sheet and which has been cut into the special configuration shown so that it can form not only the lateral wall portions but also the floor of the outer enclosure and the pallet-forming members if desired.

The sections 51 generally form the lateral walls of the enclosure while section 52 forms the floor thereof. Between sections 51 bending zones 53 are provided. At the ends of sections 51, zones 54 and 55 are provided to be overlapped and welded together. In this case, the horizontal bars 56 at each end of the sections 51 will be overlapped and welded together at regions adjoining the bend along the fourth corner of the structure of which the bends 53 form the other three vertical corners.

A further bend region 57 allows the section 52 to be swung under the lateral-wall arrangement 51 and regions 58 can be turned under and overlapped with the floor-forming section 52 and welded thereto while the regions 59 can be bent upwardly along the lateral walls formed by the sections 51 and welded thereto.

Obviously, instead of forming the entire enclosure from a single blank, any combination of wall sections can form one blank which can be joined to other wall sections formed by one or more other blanks.

We claim:

1. A transport and storage container for flowable materials, the container comprising:

an outer side comprised of a plurality of vertical flat panels each formed by a gridwork of horizontal and vertical bars, the horizontal bars being interconnected with the panels forming an upwardly open rectangular-section tube;

a generally rectangular bottom formed as a gridwork of horizontal bars and having respective sides juxtaposed with the panels of the side, the vertical bars of the side having horizontally bent lower ends lying against respective bars of the bottom, at least some of the bent lower ends of adjacent panels of the side crossing one another;

an inner vessel composed of a plastic material enclosed by the outer side and supported on the bottom; and respective welds securing together the crossing lower ends of the side and securing the lower ends and the bars of the bottom together.

2. The container defined in claim 1, further comprising pallet-foot formations shaped to receive a fork of a forklift vehicle connected to said bottom.

3. The container defined in claim 1 wherein said inner vessel is formed with a downwardly and inwardly converging floor sloping toward an outlet fitting of said vessel and said bottom has a slope relative to the horizontal downwardly and inwardly toward said outlet fitting.

4. The container defined in claim 3 wherein said bottom has in plan view a substantially Y-shaped bent region defined by bends in the bars of said bottom with a shank of the Y being inclined toward said outlet fitting.

5. The container defined in claim 3 wherein said floor has a greater slope than said bottom to the horizontal in a partially filled condition of said vessel.

6. A transport and storage container for flowable materials, the container comprising:

an outer side comprised of a plurality of vertical flat panels each formed by a gridwork of horizontal and vertical bars, the horizontal bars being interconnected with the panels forming an upwardly open rectangular-section tube;

a generally rectangular bottom formed as a gridwork of horizontal bars and having respective sides juxtaposed with the panels of the side, the vertical bars of the side having horizontally bent lower ends lying against respective bars of the bottom, at least some of the bent lower end of adjacent panels of the side crossing one another;

an inner vessel composed of a plastic material enclosed by the outer side and supported on the bottom;

additional bars i the bottom lying against bars of the bottom and against the bent lower ends of the vertical bars of the side and forming pallet-like feet projecting downward from the bottom; and respective welds securing together the crossing lower ends of the side, the lower ends and the bars of the bottom and the additional bars.

7. The container defined in claim 6 wherein said additional bars are disposed along an interior of said bottom.

8. The container defined in claim 6 wherein said additional bars are disposed along an exterior of the container.

* * * * *